US010378727B2

(12) United States Patent
Barnes et al.

(10) Patent No.: US 10,378,727 B2
(45) Date of Patent: Aug. 13, 2019

(54) LIGHT EMITTING FLAT FLASH LIGHT WITH A FOLDED LIGHT PATH OPTIC

(71) Applicants: Mike Barnes, Dunnellon, FL (US); Gregory Shepherd, Fruitland Park, FL (US)

(72) Inventors: Mike Barnes, Dunnellon, FL (US); Gregory Shepherd, Fruitland Park, FL (US)

( * ) Notice: Subject to any disclaimer, the term of this patent is extended or adjusted under 35 U.S.C. 154(b) by 0 days.

(21) Appl. No.: 15/732,327

(22) Filed: Oct. 25, 2017

(65) Prior Publication Data

US 2019/0120461 A1 Apr. 25, 2019

(51) Int. Cl.

| | |
|---|---|
| ***F21L 4/04*** | (2006.01) |
| ***F21V 7/10*** | (2006.01) |
| ***F21V 29/50*** | (2015.01) |
| ***F21V 23/04*** | (2006.01) |
| ***F21L 4/00*** | (2006.01) |
| ***F21V 21/088*** | (2006.01) |
| ***F21V 7/04*** | (2006.01) |
| *F21Y 115/10* | (2016.01) |

(52) U.S. Cl.

CPC ..... *F21V 7/10* (2013.01); *F21L 4/005* (2013.01); *F21V 7/04* (2013.01); *F21V 21/0885* (2013.01); *F21V 23/04* (2013.01); *F21V 29/50* (2015.01); *F21Y 2115/10* (2016.08)

(58) Field of Classification Search

CPC ..... F21V 21/0885; F21V 4/005; F21V 23/04; F21V 29/50; F21Y 2115/10

See application file for complete search history.

(56) References Cited

U.S. PATENT DOCUMENTS

| | | | | | |
|---|---|---|---|---|---|
| 4,783,725 | A * | 11/1988 | Schaller | F21L 15/02 | 362/157 |
| 6,039,454 | A * | 3/2000 | Hallgrimsson | A44B 15/005 | 362/116 |
| 6,547,423 | B2 * | 4/2003 | Marshall | F21V 5/04 | 257/E33.072 |
| 2003/0123253 | A1 * | 7/2003 | Krietzman | E05B 17/103 | 362/200 |
| 2003/0206409 | A1 * | 11/2003 | Parsons | A44B 15/005 | 362/183 |
| 2005/0152138 | A1 * | 7/2005 | Tatebe | A44B 15/005 | 362/200 |
| 2016/0033092 | A1 * | 2/2016 | Killion | F21V 7/0075 | 40/555 |
| 2018/0010741 | A1 * | 1/2018 | Barnes | F21L 4/027 | |

* cited by examiner

*Primary Examiner* — Ali Alavi

(57) ABSTRACT

A hand held flat flashlight about the size of a cell phone with a 3.8 degree tightly focused light beam with a folded light path optic.

11 Claims, 7 Drawing Sheets

LIGHT EMITTING FLAT FLASH LIGHT WITH A FOLDED LIGHT PATH OPTIC

BACKGROUND OF THE INVENTION

The present invention relates generally to a more readily available flashlight that can be carried in the shirt or jacket pocket or hung on the firemen's coat lapel clip.

Typically, in law enforcement when the patrol officer is outside his car at night and doesn't have his flashlight with him it would be convenient to have an auxiliary substitute flashlight that could be carried in the shirt pocket. It would be desirable to provide a flat flashlight that would fit comfortably in the shirt or jacket pocket or hang on the firemen's coat that has a powerful and well focused beam of light such as a spot light.

Also, firemen hang a flashlight on a lapel clip on the front of their coat. It is important that their flashlight be light in weight and have a powerful and focused beam of light to penetrate smoke. The more focused the beam of light the better the smoke penetration. Most flashlights that firemen use have a good enough light focus but all these flashlight's have light leakage or light spill that form a large somewhat dimmer ring around the main light focus having a halo effect. This light spillage lights up the smoke close to the firemen and impairs the firemen from seeing good enough through the smoke.

It would therefore be desirable to provide a flashlight with a tightly focused beam of light with no light spillage that could be hung on the firemen's coat lapel clip that's small enough and light in weight enough as to not interfere with the firemen's movements.

SUMMARY OF INVENTION

Aspects of the present invention are obviously advantageous to everyone that may use or need a flashlight especially in emergency situations.

In accordance with one aspect of the invention, a hand held flat flashlight about the size of a cell phone with a 3.8 degree beam angle 60 mm ultra narrow Catadioptric optic with a folded light path, a power source, a switch, an LED that emits light. The flat flashlight could have a strobe light and an S.O.S. function.

In another aspect of the present invention, the flat flashlight uses a 60 mm ultra narrow Catadioptric optic with a folded light path to narrow the beam angle similar to the technology used in telescopes. The 60 mm ultra narrow Catadioptric optic with a folded light path used in the present invention can only be used with one LED that is fitted into the back of the optic. The 60 mm ultra narrow Catadioptric optic with a folded light path is 60.0 mm in diameter and 11.5 mm thick, which is the only optic thin enough to be used in a flat flashlight with a tightly focused long beam throw distance, is manufactured by Carlico Optics, London, England.

The 60 mm ultra narrow Catadioptric optic with a folded light path beam angle and Lumen output were measured at two distances, 10 feet and 30 feet. The 60 mm ultra narrow Catadioptric optic with a folded light path beam angle was determined to be 3.8 degrees which was mathematically calculated by turning the flat flashlight's LED on and measuring the distance to the illuminated target and then measuring the size of the lighted square on the target area. At 10 feet the flat flashlight's 60 mm ultra narrow Catadioptric optic with a folded light path projected an illuminated 8 inch square spot on a white surface and at 30 feet the flat flashlight's 60 mm ultra narrow Catadioptric optic with a folded light path projected an illuminated 24 inch square on a white surface. Using the distance and spot size the divergence angle was calculated to be 3.8 degrees.

In another aspect of the present invention, the flat flashlight's case is made of a polycarbonate plastic with a 55.0 mm hole for the 60 mm ultra narrow Catadioptric optic with a folded light path to fit into and for protection covered with a scratch resistant chemically treated 1.00 mm thick by 60.0 mm dia. glass cover, a 1.0 mm by 60.0 mm dia. O-ring fits around the 1.0 mm by 60.0 mm chemically treated glass cover to keep water out. The flat flashlight case contains a LED 3 amp driver, an LED, a charging port, a rechargeable battery measuring 9.5 mm thick by 40.0 mm wide and 70.0 mm long, and a 60 mm ultra narrow Catadioptric optic with a folded light path and a switch.

The case has a aluminum heat sink back cover with a 1.0 mm gasket seated between the two. A ring can be molded into top of case for firemen to attach the flat flashlight to their coat lapel clip.

In yet another aspect of the invention, the ultra narrow Catadioptric optic with a folded light path could be used in a conventional round body flash light with variable optic diameters.

In yet another aspect of the invention, the 60 mm ultra narrow Catadioptric optic with a folded light path could be used in a cell phone case.

Furthermore, aspects of this invention will help make the firemen's job safer when the use of special lighting is needed for his safety.

BRIEF DESCRIPTION OF THE DRAWINGS

The drawings should be understood to present an illustration of various aspects of the invention and/or principles involved, and not to limit the scope of the subject matter as set forth in the claims.

DETAILED DESCRIPTION OF THE DRAWINGS

The drawings represent only one aspect of this invention and should not be limited to a flat flashlight only.

The present invention relates to a hand held device that emits light. Furthermore, aspects of the invention are illustrated in the remainder of this disclosure with reference to a flat flashlight about the size of a cell phone.

Figure 1:
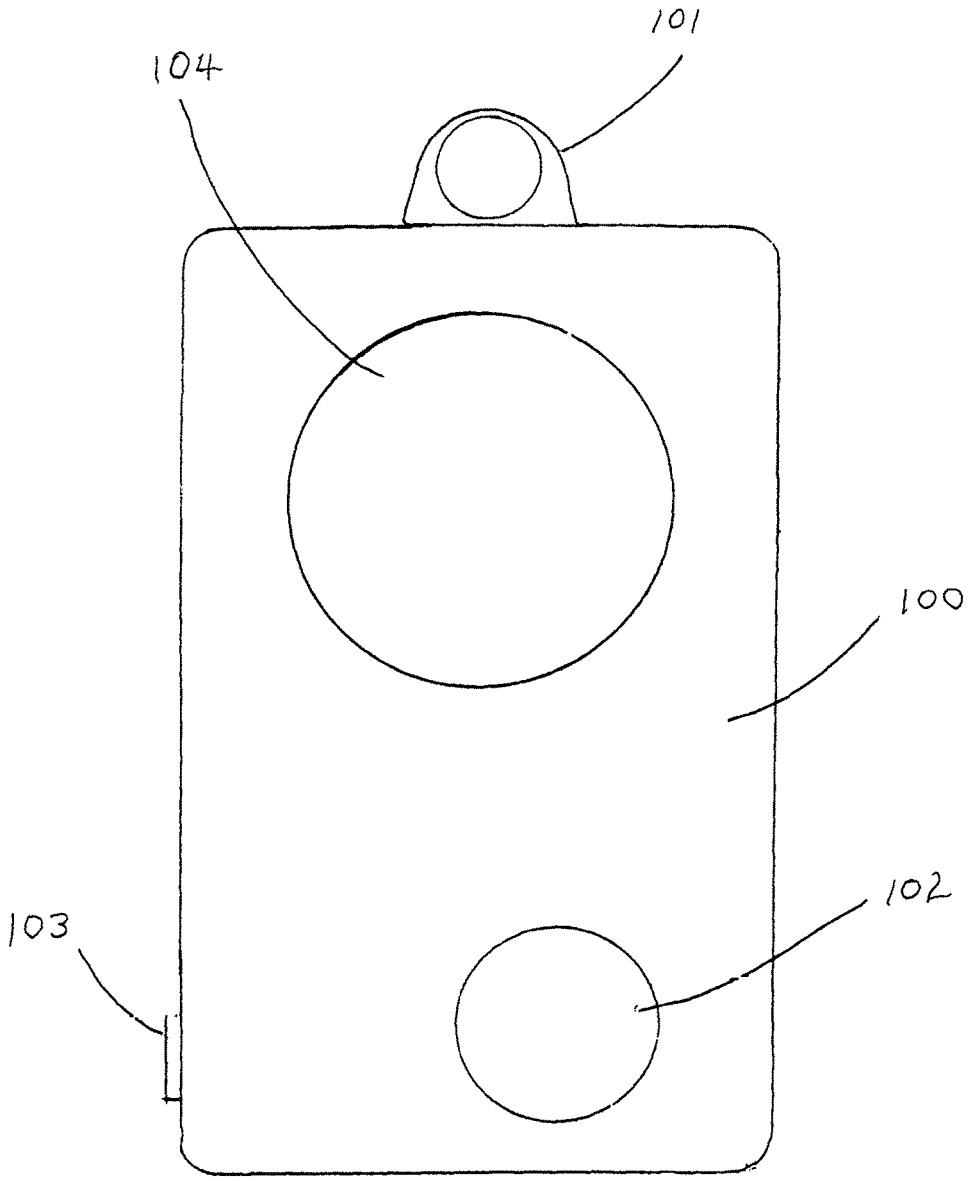
FIG. 1. shows the front view of the flat flashlight
Figure 2:
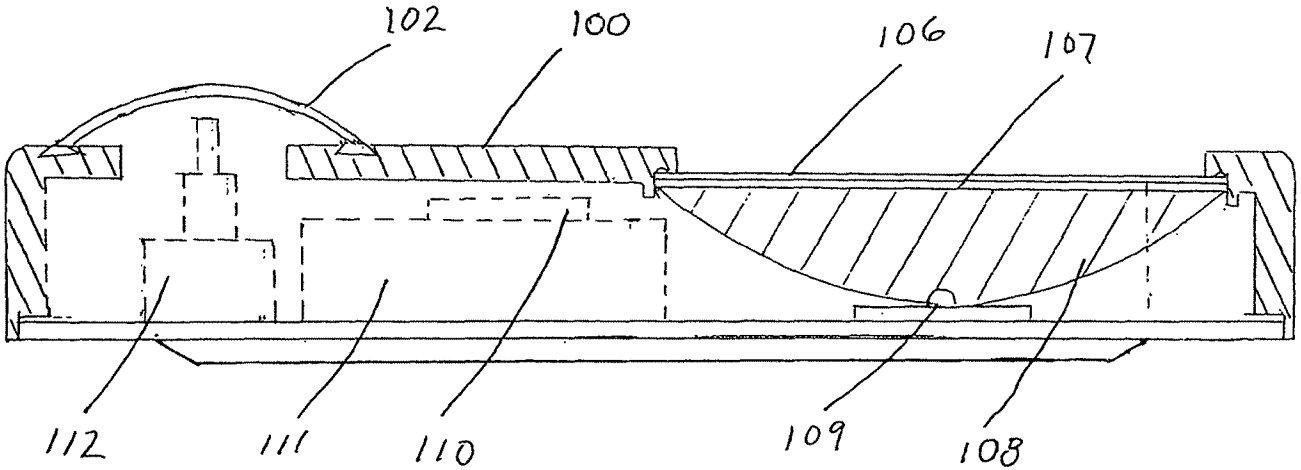
FIG. 2. shows a cut-away side view of the flat flashlight

The representative flat flashlight that emits a tightly focused beam of light as illustrated in FIG. 1, The case 100, with a ring on top of case for hanging on firemen's coat lapel 101, also with a rubber boot switch cover 102, a charging port 103, a 55.0 mm diameter hole for mounting the 60 mm ultra narrow Catadioptric optic with a folded light path 104, FIG. 2, side cut away view of case 100, also with a rubber boot switch cover 102, chemically treated 1.00 mm by 60.0 mm dia. glass optic cover 106, a 1.0 mm by 60.0 mm dia.

Figure 3:
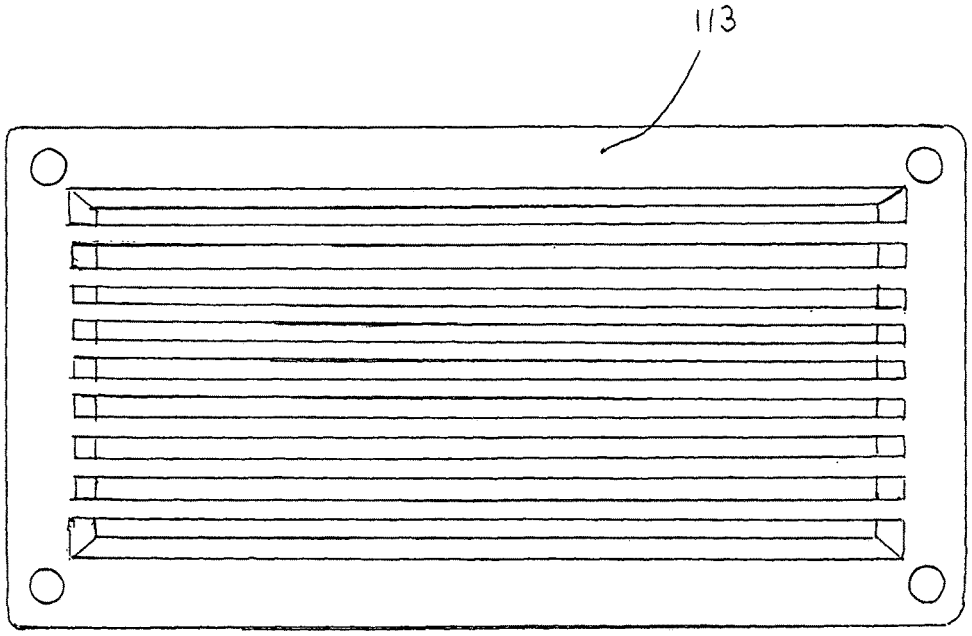
FIG. 3. shows a top view of the aluminum heat sink back cover
Figure 4:
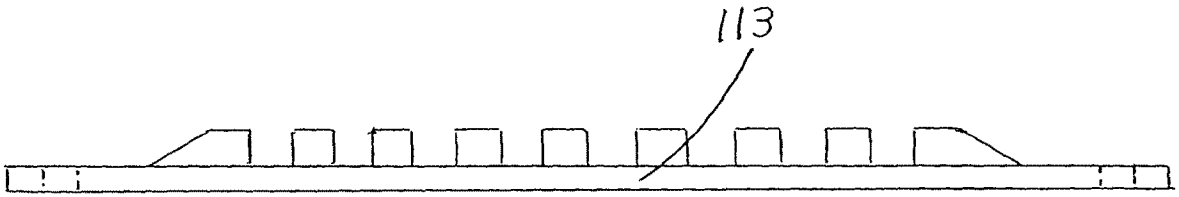
FIG. 4. shows an end view of the aluminum heat sink back cover
Figure 5:
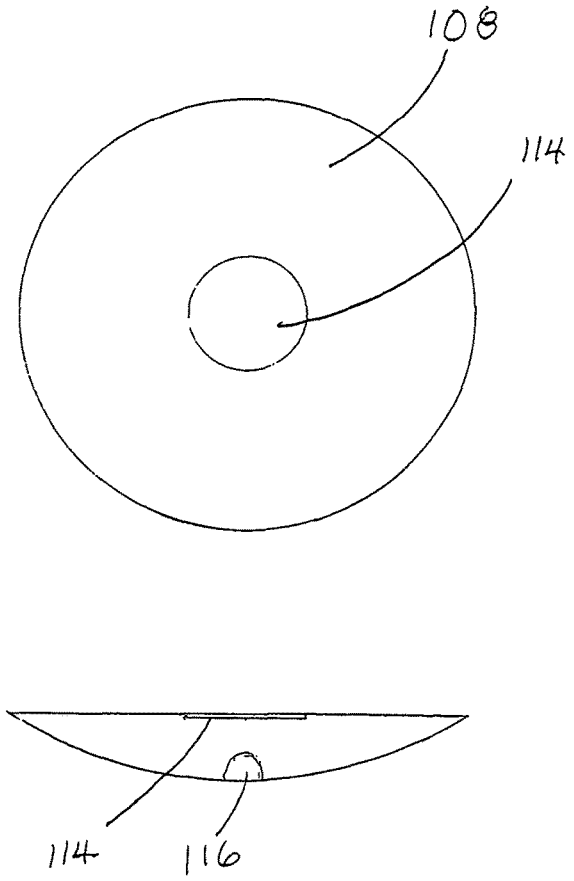
FIG. 5. shows a front and side view of the 60 mm ultra narrow Catadioptric optic with a folded light path FIG. 6. depicts how the test was done for the lumen output and beam angle FIG. 7. shows the mathematical formula for finding the bream angle
Figure 6:
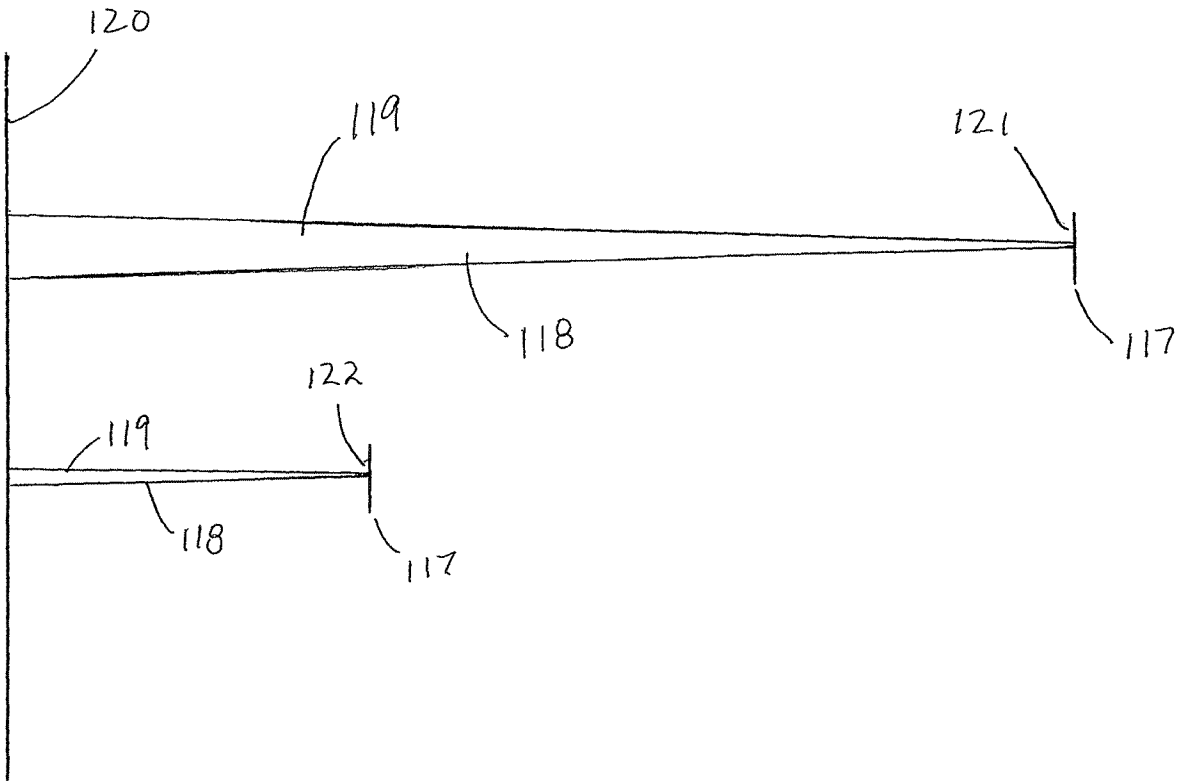
Figure 7:
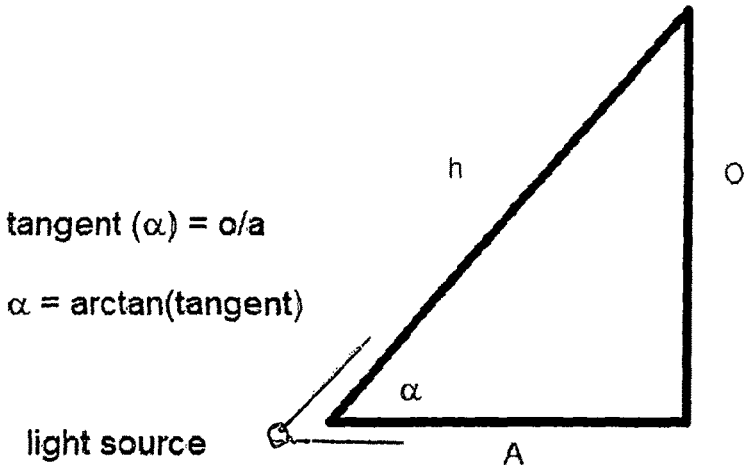

O-ring 107, a 10 W Cree LED 109, a 60 mm ultra narrow Catadioptric optic with a folded light path 108, a 3.7V Lithium Polymer rechargeable battery 111, an LED driver and PCB 110, switch 112. FIG. 3, aluminum heat sink back cover 113. FIG. 4. end view of the aluminum heat sink back cover 113. FIG. 5, front and side view of 60 mm ultra narrow Catadioptric optic with a folded light path 108, 16.0 mm diameter center reflection mirror 114 in the 60 mm ultra narrow Catadioptric optic with a folded light path 108, a divot 5.25 mm deep in the center back 116 of the 60 mm ultra narrow Catadioptric optic with a folded light path 108 for the LED 109 which fits 3 mm deep into the 5.25 mm deep divot, FIG. 6. diagram for the beam angle 118, the target wall 120, the flat flashlight 117, calculated beam angle of 3.8 degrees 119, FIG. 7, beam angle divergence formula used in the testing.

Although preferred embodiments of the invention have been disclosed, it should be understood that various changes, modifications and substitutions may be incorporated in the embodiment without departing from the spirit of the invention, which is defined by the following claims.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. A light emitting flat flashlight comprising:

An ultra narrow Catadioptric optic with a folded light path, a power source, a means of controlling the electrical power to the LED, such as a switch, an aluminum heat sink, an LED driver, an LED, whereby a person who uses the flat flashlight can store it in the shirt or jacket pocket.

2. The light emitting flat flashlight of claim 1, characterized by a means of controlling the electrical power to the LED, such as a switch that turns the LED on and off and operable by the user.

3. The light emitting flat flashlight of claim 2, characterized by using a ring attached to the top of the flat flashlight used to hang the flat flashlight on the fireman's coat lapel clip.

4. The light emitting flat flashlight of claim 3, characterized by using an ultra narrow Catadioptic optic with a folded light path that produces a tightly focused beam of light.

5. The light emitting flat flashlight of claim 4, characterized by using a heat sink.

6. The light emitting flat flashlight of claim 5, characterized by using a power source, such as a rechargeable battery.

7. The light emitting flat flashlight of claim 6, characterized by using an electronically controlled circuit that provides a constant current to the LED, such as an LED driver.

8. The light emitting flat flashlight as claimed in claim 1, characterized by using an ultra narrow Catadioptic optic with a folded light path in a cell phone case.

9. The light emitting flat flashlight as claimed in claim 1, wherein the ultra narrow Catadioptic optic with a folded light path is used in a conventional round flashlight.

10. The light emitting flat flashlight as claimed in claim 1, wherein the ultra narrow Catadioptic optic with a folded light path can be made in many different diameters.

11. The light emitting flat flashlight as claimed in claim 1 characterized by using a variable light output from zero to full power.

* * * * *